US005743451A

United States Patent [19]

Kahn

[11] Patent Number: 5,743,451

[45] Date of Patent: Apr. 28, 1998

[54] TOOL BELT TOOL TOTE

[76] Inventor: Peter P. Kahn, P.O. Box 440, Montauk, N.Y. 11579

[21] Appl. No.: 790,252

[22] Filed: Jan. 28, 1997

Related U.S. Application Data

[60] Provisional application No. 60/016,444, Apr. 29, 1996.

[51] Int. Cl.[6] ..... A45F 5/00

[52] U.S. Cl. ..... 224/268; 224/666; 224/904

[58] Field of Search ..... 224/269, 268, 224/904, 660, 663, 666, 671, 676, 677, 678

[56] References Cited

U.S. PATENT DOCUMENTS

| | | | |
|---|---|---|---|
| D. 275,527 | 9/1984 | Gee | 224/666 X |
| 2,865,111 | 10/1958 | Wolfe | 224/268 |
| 4,372,468 | 2/1983 | Harvey | 224/268 |
| 4,883,290 | 11/1989 | Landa | 224/677 X |
| 4,962,873 | 10/1990 | Schattel | 224/268 X |

*Primary Examiner*—Renee S. Luebke

*Attorney, Agent, or Firm*—Peter A. Borsari; Eric W. Trucksess

[57] ABSTRACT

A tool-toting device facilitating the carrying and retention by a workman of a hand tool having a clip for attaching the device to a belt such as a workman's tool-belt. A rigid hook depends through fastening means from the clip and has the ability to swivel as the workman moves to maintain the center of gravity of a tool attached to the hook. Rigidity of the hook ensures that the workman will be able to replace the tool onto the toting device or to remove it therefrom single-handedly. Further, the hook is rotatably positionable to permit the workman to position his tool in a comfortable fashion.

16 Claims, 2 Drawing Sheets

TOOL BELT TOOL TOTE

RELATED APPLICATION

The present application claims the benefit of U.S. patent application Ser. No. 60/016,444, filed Apr. 29, 1996.

FIELD OF INVENTION

The present invention relates to the field of carrying or toting devices, and more particularly to a tool belt attachment that allows a workman to tote a desired tool, such as a cordless drill, hammer or the like, that will be used intermittently, thereby freeing the workman's hands when he is not using the tool. The inventive carrying device is a C-shaped clip which may be directly attached to a standard belt or workman's tool-belt and has an aperture through at least its front face from which a hook depends. A terminal swivel having a perforated rounded top portion and a hollow cylinder joins the hook to the clip through a fastener such as a rivet or screw. In use, a tool hanging from the hook may freely swivel to maintain its center of gravity so that the tool will remain securely attached to the tool tote while remaining easily accessible to the workman.

BACKGROUND OF THE INVENTION

When building or repairing large scale structures such as those encountered in home restoration work, a workman may need to carry a tool while climbing upon a staging or ladder to access his work site. Tool belts of various designs have been provided to retain a desired tool while allowing the workman to keep his hands free for climbing. Exemplary tool belts are provided with leather or cloth loops which depend from the belt and which serve as tool retainers. Although useful, tool belts can present certain inconveniences to the workman which limit their usefulness. Because cloth is not necessarily a rigid structure, cloth loops may close when not in use, making it difficult for the workman to replace the tool into the loop with one hand. Although leather loops are more rigid, similar problems can arise. Another disadvantage with tool belts using loops for retaining work tools is that the tool being retained therein remains in a fairly static position; in other words, the tool fails to swivel as the workman moves about. This situation can prove dangerous, as for example when the tool is a heavy instrument such as a hammer or has sharp edges, in that the tool may slip out of its loop when the workman is climbing and the hammer head approaches an inverted position, thereby endangering personnel and materials located below. Moreover, a cloth loop may tightly constrict about a tool handle as the tool settles into position, thereby making it difficult to remove the tool when it is needed.

Despite the teachings of the prior art, a need still exists for a tool toting device which may be attached to a belt or tool-belt that facilitates carrying a desired tool in a safe and convenient manner freeing up a workman's hands. Such a device should be rigid enough that when it is desired to insert a tool into it, a worker may do so with one hand. Such a device also should permit swiveling of a carried tool so that the tool's center of gravity may not be shifted to a dangerous attitude so that the tool remains within the safe control of the workman even while climbing about in a work space.

SUMMARY OF THE INVENTION

Accordingly, it is an object of the present invention to provide a tool-belt tote device in which the aforementioned problems can be overcome comprising a clip affixed to a belt from which depends a swivelable hook for retaining a desired tool.

It is a further object of the present invention to provide a tool-belt tote device for retaining a tool which can be removed single-handedly therefrom.

It is another object of the present invention to provide a tool-belt tote device which permits the workman to adjust the position of a retained tool to an attitude which is comfortable and easily accessible from both the left-hand and right-hand side of the workman.

It is still another object of the present invention to provide a tool-belt tote device which is economical to manufacture, durable in construction and effective in operation.

Additional objects, advantages and novel features of the present invention will be set forth in part in the description which follows and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

BRIEF DESCRIPTION OF THE DRAWINGS

The present invention will be better understood with reference to the appended drawing sheets, wherein.

DETAILED DESCRIPTION

Figures 1, 2:
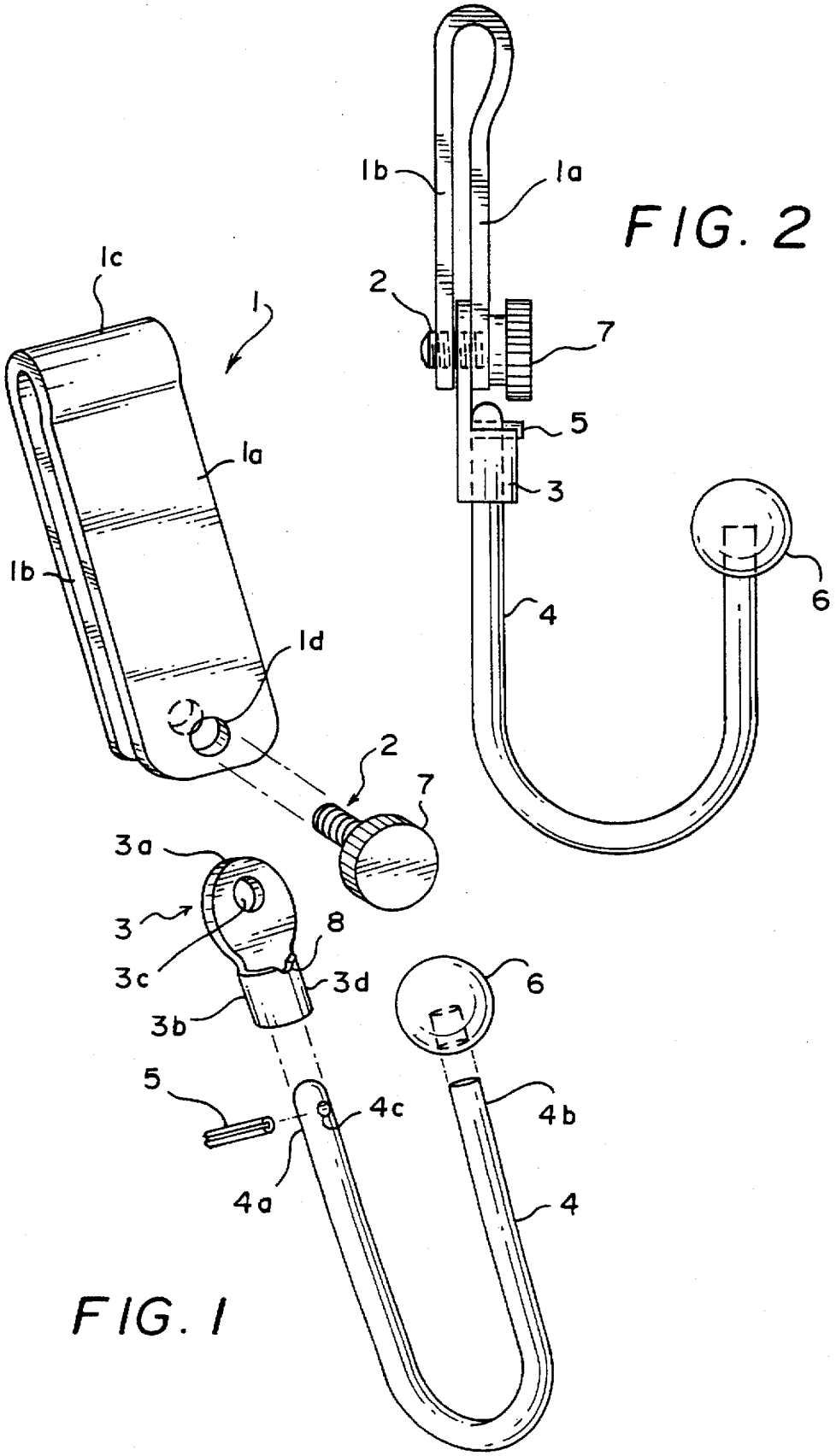
FIG. 1 is an exploded perspective view of a first embodiment of the tool-belt tote device of the present invention.
FIG. 2 is a side perspective view of the tool-belt tote device of the present invention.

The present invention relates to a device for supporting and carrying a variety of tools on a belt, and in particular on a standard tool-belt. In a first embodiment, the device comprises a clip 1, a threaded screw or bolt 2, a terminal swivel 3, a hook 4 and a clinch pin 5. Referring to the FIGS. 1 and 2, the device of the present invention comprises a C-shaped clip 1 having a front face 1*a*, a rear face 1*b* and rounded top end 1*c*. Disposed through said front and rear faces, distal to said top end are a pair of threaded matching apertures 1*d* in register. A terminal swivel 3 having a rounded top portion 3*a* with an aperture 3*c* disposed therein is inserted between said front and rear faces such that said aperture 3*c* is aligned with threaded apertures 1*d* and is secured to said clip 1 by means of a threaded screw or bolt 2, one end of which terminates in a knurled knob 7. The threaded screw or bolt 2 should extend through each of the apertures in the front face 1*a*, the terminal swivel 3 and the rear face 1*b* in such a manner that said swivel is securely retained between the front and rear faces, yet can still swivel 180° about the threaded screw 2.

The lower portion 3*b* of the terminal swivel is in the form of a hollow cylinder having a rounded flange or groove 8 at the upper end 3*d* thereof. The inside diameter of the hollow cylinder 3*b* is of sufficient width to receive the upper end 4*a* of a hook 4 having a bore 4*c* disposed near said upper end. The upper end 4*a* of said hook is introduced through said hollow cylinder such that aperture 4*c* passes through the hollow cylinder. In order to secure the hook 4 to the terminal swivel 3, a clinch pin 5 is inserted through bore 4*c* and rests on rounded flange or groove 8. In this manner, the hook 4 is prevented from sliding out of the cylinder 3*b*. The hook 4 may be composed of any suitable material as is well known in the art, including, for example, hard or soft metals or metal alloys, hard plastics, flexible plastics and combinations thereof, for example, a plastic sheath covering a metal core. Preferably, the hook 4 is made from a soft aluminum metal or alloy thereof. A ball, knob or similar device 6 may be inserted over the lower end 4*b* of the hook. Use of the ball protects the workman from contacting the lower end 4*b* of the hook with his hand and prevents undue wear to the device. Preferably, the lower end 4*b* of the hook may be threaded and the ball 6 may have a recess 6*a* with mating threads so that the ball may be readily screwed onto the hook.

The clip 1 can be fastened to a belt, tool belt, tool holster or any other conventional means for carrying tools, simply by inserting the belt, tool belt etc. into the space between the front face 1*a* and the rear face 1*b* above the threaded screw 2 such that the front face faces outwardly. Alternatively, threaded screw 2 may be removed from the clip 1 by turning knurled knob 7 so that the clip may be attached to a belt, after which the screw may be replaced to secure the device. Clip 1 may be composed of any suitable material that is well known in the art, including, for example, hard or soft metals or metal alloys, hard plastics, flexible plastics and combinations thereof, for example, a metal clip having an outer plastic covering. A variety of tools can be hung from the hook 4; once a tool is suspended from the hook 4, the hook automatically adjusts for the tool's center of gravity by the swivelling action of the terminal swivel 3. In this manner, the tool not only is prevented from falling off of the hook, but also is readily accessible to the tool belt wearer.

Figure 3:
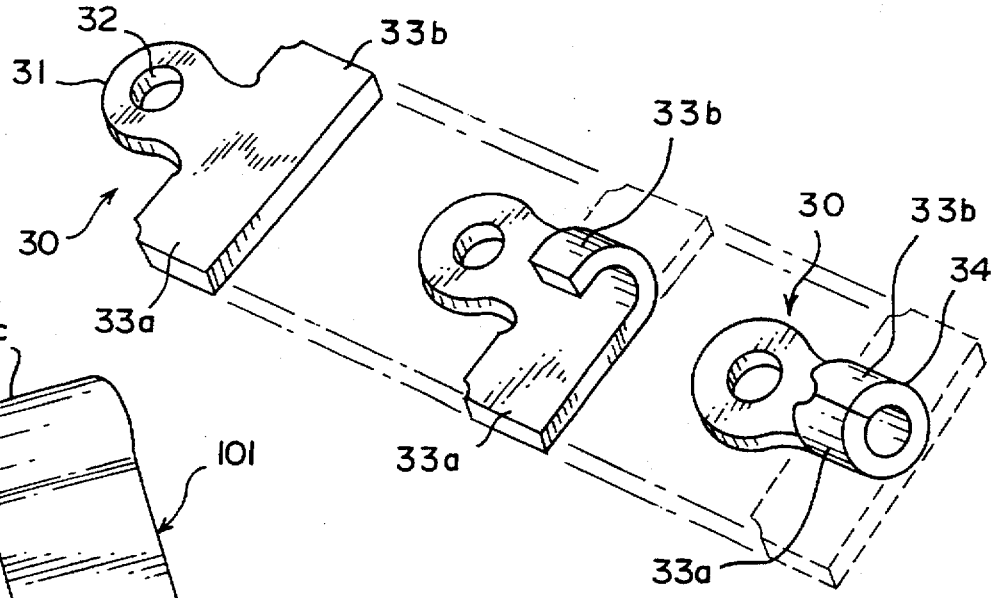
FIG. 3 is a top exploded view of an alternate embodiment of the terminal swivel joining the clip and hook of the present invention.

FIG. 3 shows an alternate embodiment of the terminal swivel used in the present invention, wherein a terminal swivel 30 comprises a rounded top portion 31 having an aperture 32 disposed therein and a bottom portion having flanges 33*a* and 33*b* extending therefrom. In this alternate embodiment, the terminal swivel 30 is composed of a flexible or malleable material, for example, a soft aluminum metal or alloy. By utilizing a flexible or malleable material, the flanges 33*a* and 33*b* can be bent or shaped towards each other to form a hollow cylinder 34. The weight of a tool suspended on the hook 4 will cause the clinch pin 5 to engage the groove 8 in a manner which prevents rotation of the hook within the hollow cylinder 34 while still allowing the terminal swivel 30 to adjust to the center of gravity of the tool.

Figure 4:
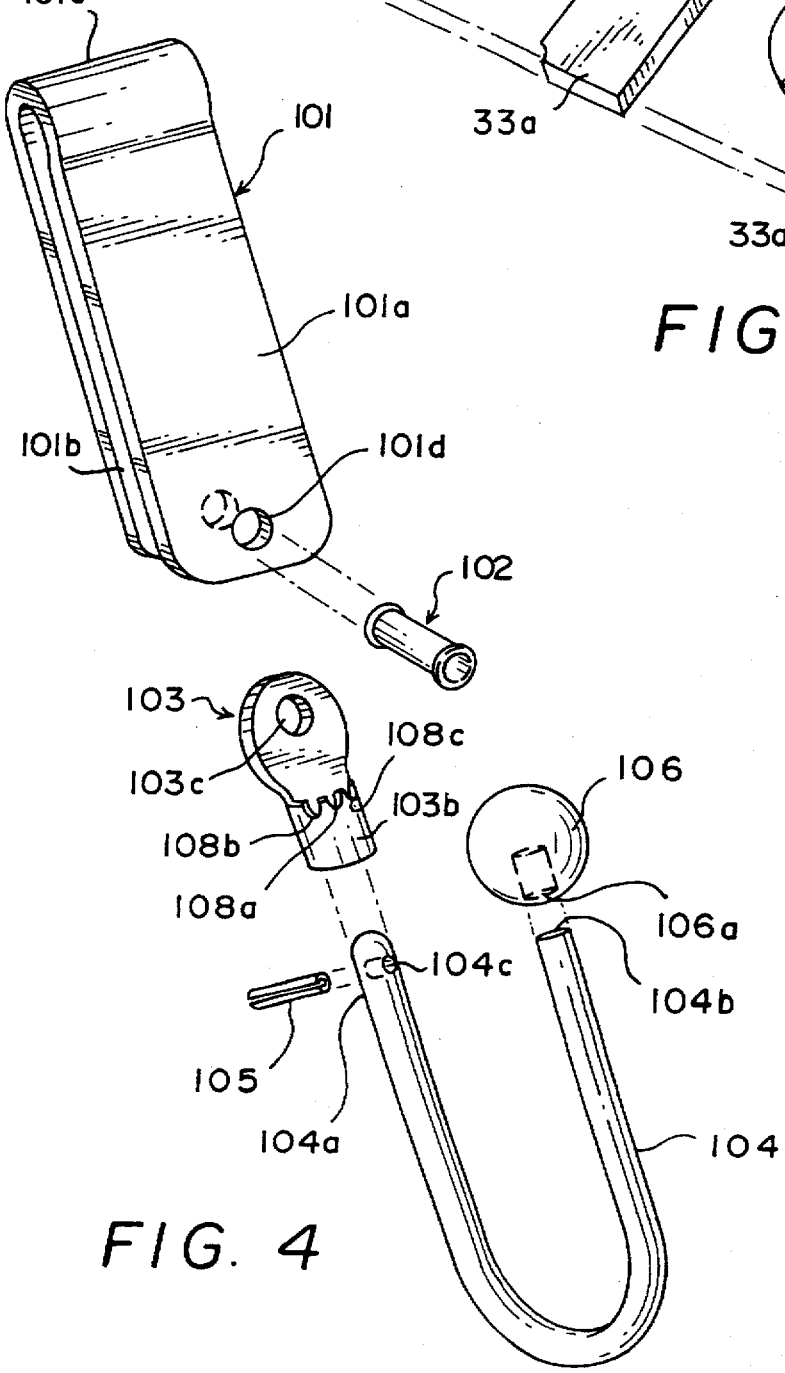
FIG. 4 is an exploded perspective view of a second embodiment of the tool-belt tote device of the present invention.

FIG. 4 shows another embodiment of the present invention wherein clip 101, having front face 101*a* and rear face 101*b* is provided with an aperture 101*d* in its front face only, said aperture being threaded or unthreaded and disposed through front face 101*a* distal to top end 101*c*. The terminal swivel 103 having an aperture 103*c* is permanently fastened to the clip by means of a rivet 102 through apertures 101*d* and 103*c*. In this manner, hook 104 depends from the front face 101*a* of the clip rather than from between the front face and the rear face 101*b*. Such an arrangement facilitates placement of the clip over the workman's belt by obviating the need to thread the belt into the clip. In this embodiment of the tool belt tool tote, three grooves 108*a*, 108*b* and 108*c* are formed at the top surface of the hollow cylinder 103*b* of the terminal swivel 103, a first groove 108*a* at a centered position and a second groove 108*b* and third groove 108*c* located to the right and to the left of the first groove, respectively. Each groove is configured to be of sufficient depth to securely engage clinch pin 105 inserted in bore 104*c* in upper end 104*a* of hook 104 to prevent unwanted rotation of the hook. This plurality of grooves offers the workman a variety of angles from which to hang his tool so that it is both secure and comfortable. It is to be understood that the number of grooves is essentially arbitrary, and the hollow cylinder 103*b* may be manufactured with any number of grooves to increase the workman's options in directing the attitude of a hanging tool. The workman may adjust the positioning of a hanging tool by pushing up on the hook 104 so that the clinch pin 105 disengages a particular groove and then rotating and releasing the hook so that the clinch pin engages a different groove. As with the previous embodiments, the terminal swivel 103 permits a hanging tool to maintain its center of gravity, regardless of which groove is engaged. Finally, a ball 106 having a recess 106*a* may be screwed onto the lower end 104*b* of the hook through the use of matching threads.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A tool-belt tool tote device comprising:

a clip having a front face and a rear face, said front face and said rear face being perforated with matching apertures in register;

a hook having a first end and a second end, said first end having a bore therethrough;

a terminal swivel comprising a flat, rounded top portion and further comprising a hollow cylinder having a top end and being configured to receive said first end of said hook;

a clinch pin dimensioned to be received in and retained by said bore in said first end of said hook; and a fastening means for securing said terminal swivel to said clip.

2. A tool-belt tool tote according to claim 1, wherein said clip has a C-shaped cross section.

3. A tool-belt tool tote according to claim 2, wherein said clip is fabricated from hard or soft metals or metal alloys, hard plastics, flexible plastics or combinations thereof.

4. A tool-belt tool tote according to claim 1, wherein an aperture is disposed within said flat rounded top portion of said terminal swivel and wherein said fastening means comprises means that penetrate said aperture disposed in said terminal swivel and said apertures in said clip.

5. A tool-belt tool tote according to claim 4, wherein said matching apertures have internal threads and said fastening means is a threaded screw having a knurled knob.

6. A tool-belt tool tote according to claim 1, wherein said top end of said hollow cylinder of said terminal swivel has at least one groove, said groove being deep enough to engage and to retain said clinch pin, thereby preventing rotation of said first end of said hook within said hollow cylinder.

7. A tool-belt tool tote according to claim 1, further comprising a ball having a recess, wherein said second end of said hook may be inserted into said recess and retained thereto.

8. A tool-belt tool tote according to claim 7, wherein said recess and said second end of said hook are matingly threaded.

9. A tool-belt tool tote according to claim 1, wherein said hook is fabricated from hard or soft metals, metal alloys, hard plastics, flexible plastics or combinations thereof.

10. A tool-belt tool tote according to claim 9, wherein said hook is fabricated from a soft aluminum metal or alloy thereof.

11. A tool-belt tool tote device comprising:

a clip having a front face and a rear face, said front face having an aperture disposed at one end thereof;

a hook having a first end and a second end, said first end having a hole disposed therethrough;

a terminal swivel comprising a flat, rounded top portion having an aperture disposed therein and further comprising a hollow cylinder having a top end and being configured to receive said first end of said hook;

a clinch pin dimensioned to be received in and retained by said hole in said first end of said hook; and a fastening means for securing said terminal swivel to said clip.

12. A tool-belt tool tote according to claim 11, wherein said clip has a C-shaped cross section.

13. A tool-belt tool tote according to claim 11, wherein said fastening means comprises means that penetrate said aperture in said terminal swivel and said aperture in said clip.

14. A tool-belt tool tote according to claim 11, wherein said fastening means is a rivet.

15. A tool-belt tool tote according to claim 11, wherein said top end of said hollow cylinder of said terminal swivel is provided with a plurality of grooves, each of said grooves being deep enough to engage and to retain said clinch pin, thereby preventing rotation of said first end of said hook within said hollow cylinder.

16. A tool-belt tool tote according to claim 15, further comprising a ball having a recess, wherein said second end of said hook may be inserted into said recess and retained therein.

* * * * *